US008808553B2

(12) United States Patent
Goto

(10) Patent No.: US 8,808,553 B2
(45) Date of Patent: Aug. 19, 2014

(54) PROCESS FOR PRODUCING A LIQUID EJECTION HEAD

(71) Applicant: Canon Kabushiki Kaisha, Tokyo (JP)

(72) Inventor: Akio Goto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 116 days.

(21) Appl. No.: 13/685,172

(22) Filed: Nov. 26, 2012

(65) Prior Publication Data

US 2013/0180944 A1 Jul. 18, 2013

(30) Foreign Application Priority Data

Jan. 13, 2012 (JP) ..... 2012-005081

(51) Int. Cl.

| | |
|---|---|
| ***B41J 2/14*** | (2006.01) |
| ***B41J 2/16*** | (2006.01) |
| ***B41J 2/335*** | (2006.01) |
| ***B44C 1/22*** | (2006.01) |

(52) U.S. Cl.

CPC ..... *B44C 1/227* (2013.01); *B41J 2/1631* (2013.01); *B41J 2/1628* (2013.01); *B41J 2/1603* (2013.01)

USPC ..... 216/2; 347/61; 29/890.1

(58) Field of Classification Search

CPC .... B41J 2/1412; B41J 2/14145; B41J 2/1621; B41J 2/1628; B41J 2/335

USPC ..... 216/2; 347/61; 29/890.1

See application file for complete search history.

(56) References Cited

U.S. PATENT DOCUMENTS

| | | | | |
|---|---|---|---|---|
| 6,273,557 | B1 | 8/2001 | Milligan et al. | |
| 6,364,466 | B1 * | 4/2002 | Chen et al. | 347/65 |
| 2009/0095708 | A1 | 4/2009 | Kubota et al. | |

* cited by examiner

*Primary Examiner* — Binh X Tran
*Assistant Examiner* — Thomas Pham
(74) *Attorney, Agent, or Firm* — Fitzpatrick, Cella, Harper & Scinto

(57) ABSTRACT

A process for producing a liquid ejection head including a silicon substrate having a first surface and a second surface that is a surface on an opposite side to the first surface, an ejection energy generating element which is formed on a side of the first surface side and generates energy for ejecting a liquid, a cavity formed in the second surface and a liquid supply port which is formed in a bottom part of the cavity and communicates with the first surface, including, in the following order: (1) forming the cavity in the second surface of the silicon substrate by a first crystal anisotropic etching; (2) forming a chemical leading hollow in a slope of the cavity; (3) expanding the cavity by a second crystal anisotropic etching; and (4) forming the liquid supply port in a bottom face of the cavity by dry etching with the use of an ion.

11 Claims, 5 Drawing Sheets

PROCESS FOR PRODUCING A LIQUID EJECTION HEAD

BACKGROUND OF THE INVENTION

1. Field of the Invention

The present invention relates to a liquid ejection head, and a process for producing the same.

2. Description of the Related Art

A liquid ejection head which uses thermal energy and is used in an ink jet printing process and the like has a structure which uses a substrate formed from silicon or the like having a plurality of heat elements arranged thereon so as to form an array shape, and having a common heat storage layer or an electrical insulation layer provided thereon with respect to the plurality of the heat elements.

As is described in U.S. Pat. No. 6,273,557, for instance, the liquid ejection head having the above described structure includes: a fine ejection orifice for ejecting a droplet; a flow channel which communicates with the ejection orifice; and an ejection energy generating element provided in the flow channel, on a silicon substrate. A liquid supply port which communicates with the flow channel is formed in the silicon substrate.

Such a method of forming the liquid supply port of the liquid ejection head includes a method of subjecting the silicon substrate to two stages of etching treatments, as is described in U.S. Patent Application Publication No. 2009/0095708. In this method, a plurality of liquid supply ports are formed by subjecting a silicon substrate to a first etching which is crystal anisotropic etching, and subjecting the silicon substrate to a second etching which is dry etching.

SUMMARY OF THE INVENTION

The present invention provides a process for producing a liquid ejection head including a silicon substrate having a first surface and a second surface that is a surface on an opposite side to the first surface, an ejection energy generating element which is formed on a side of the first surface and generates energy for ejecting a liquid, a cavity formed in the second surface and a liquid supply port which is formed in a bottom part of the cavity and communicates with the first surface, the process including, in the following order: (1) forming the cavity in the second surface of the silicon substrate by a first crystal anisotropic etching; (2) forming a chemical leading hollow in a slope of the cavity; (3) expanding the cavity by a second crystal anisotropic etching; and (4) forming the liquid supply port in a bottom face of the cavity by a dry etching with the use of an ion.

Further features of the present invention will become apparent from the following description of exemplary embodiments with reference to the attached drawings.

DESCRIPTION OF THE EMBODIMENTS

Figure 1A:
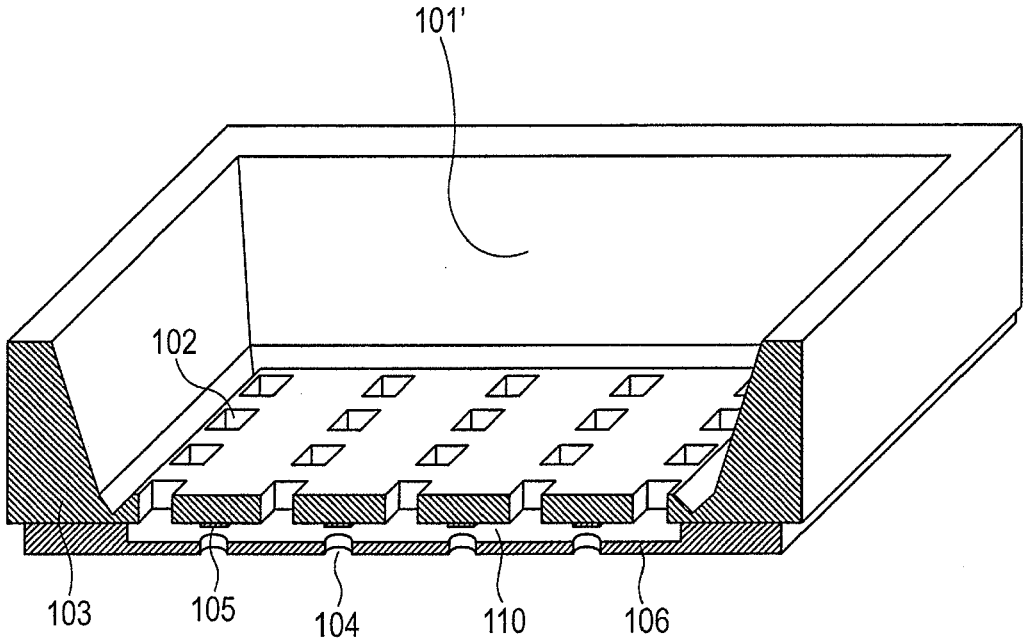
FIG. 1A is a schematic perspective view for describing a structure example of a liquid ejection head to be produced according to the present embodiment.

Preferred embodiments of the present invention will now be described in detail in accordance with the accompanying drawings.

There is a dry etching with the use of a Bosch process, as a process for forming a liquid supply port of a liquid ejection head. The dry etching with the use of the Bosch process is a process of etching silicon by repeatedly performing the steps of forming a deposition film (hereinafter referred to as depo-film) for protecting a side wall; removing the depo-film on the bottom face with a reactive ion; and etching the silicon with a radical. However, the sheath of plasma is formed so as to comply with the shape of the cavity, when the liquid supply port is formed by the dry etching for the bottom face of the cavity, accordingly the ion is affected in the vicinity of the side surface of the cavity, so that the depo-film at a position which is deviated from a desired position toward the side surface direction of the cavity is removed. Thus, the position of the removal of the depo-film deviates in the vicinity of the side surface of the cavity on the bottom face of the cavity, accordingly the position to be etched by the radical is also deviated, and consequently such a phenomenon occurs that the etching progresses while having several degrees of an angle. This phenomenon is hereafter referred to as a tilt. If the tilt occurs, the positions of apertures largely deviate from each other between the portion at which the etching has started and the portion at which the etching has been finished, particularly in the liquid supply port in the vicinity of the side surface of the cavity, and a damage is occasionally given to a wiring portion in the vicinity. In addition, because the liquid supply port itself is diagonally formed, the liquid supply ports having different sizes of the aperture portions are formed, and a dispersion of supply performances occasionally occurs among the liquid supply ports, or a liquid supply port which is not opened occasionally occurs.

In order to prevent such a problem from occurring, if a larger aperture region of the cavity is provided compared with a region in which the liquid supply port is formed so that the liquid supply port is not arranged in the vicinity of the side surface of the cavity, the mounting region becomes narrow. In addition, problems such as the peeling of a head and color mixing tend to easily occur in the mounting process.

Then, an object of the present invention is to provide a process for producing a liquid ejection head, which can form a liquid supply port with a high accuracy of an aperture position by decreasing the occurrence of a tilt when forming the liquid supply port in the bottom part of the cavity of the silicon substrate.

Embodiments of the present invention will be described below in detail. In addition, the application example of the liquid ejection head is not limited in particular, but includes, for instance, an ink jet recording head. In addition, other application examples of the liquid ejection head also include, for instance, a head for use in producing a biochip, a head for use in printing an electronic circuit, and a head for use in producing a color filter.

Figure 1B:
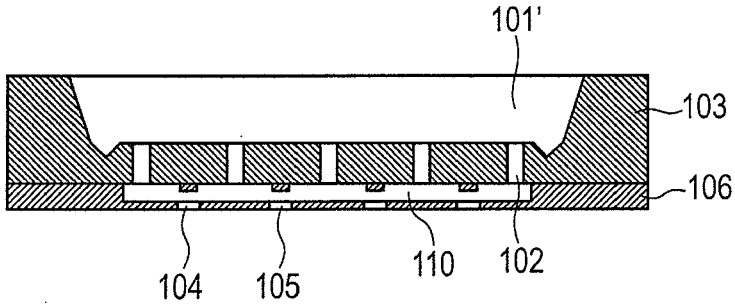
FIG. 1B is a schematic sectional view for describing the structure example of the liquid ejection head to be produced according to the present embodiment.

FIG. 1A is a schematic perspective view for describing a structure example of a liquid ejection head to be obtained with a production process of the present embodiment. FIG. 1B is a schematic sectional view of the liquid ejection head to be obtained with a production process of the present embodiment.

The liquid ejection head in the form illustrated in FIG. 1A and FIG. 1B includes a silicon substrate 103 having a first surface and a second surface on an opposite side to the first surface; a nozzle plate 106 which has been layered on the substrate 103; and an ejection energy generating element 105. On the first surface side of the substrate 103, a liquid flow path 110 which is to be filled with an ejected liquid is formed by the nozzle plate 106. Furthermore, the substrate 103 has a liquid supply port 102 formed therein which supplies the liquid such as an ink from the bottom face of a cavity 101' to the liquid flow path 110, so as to pass through the substrate 103. The cavity 101' is referred to also as a common liquid supply port, and a liquid supply port 102 is occasionally referred to also as an individual liquid supply port.

Though the details will be described later, the cavity 101' is formed by forming a cavity 101 by crystal anisotropic etching, providing a chemical leading hollow in the slope thereof and further subjecting the hollow to crystal anisotropic etching to erode the slope. For this reason, the cavity 101' is referred to also as an expanded cavity 101'.

In FIGS. 1A and 1B, a flow channel wall member constituting the inner side wall of the liquid flow path 110 and an ejection orifice member having an ejection orifice formed therein are integrally formed as the nozzle plate 106. In addition, the nozzle plate 106 may be also formed of a plurality of resin layers which have been sequentially laminated on the substrate 103.

The ejection energy generating element 105 is provided at a position facing to the ejection orifice 104 in the first surface side of the substrate 103. This ejection energy generating element 105 can be formed in a plurality of inorganic substance layers which have been laminated on the substrate 103. In addition, the ejection orifice 104 (hereinafter referred to also as nozzle) for ejecting the liquid is formed in the nozzle plate 106 so as to communicate with the liquid flow path 110.

Embodiment 1

Next, the present embodiment will be described below with reference to sectional views illustrated in FIGS. 2A to 2E and FIGS. 3F to 3I. The present invention is not limited to the following embodiments.

Figure 2A:
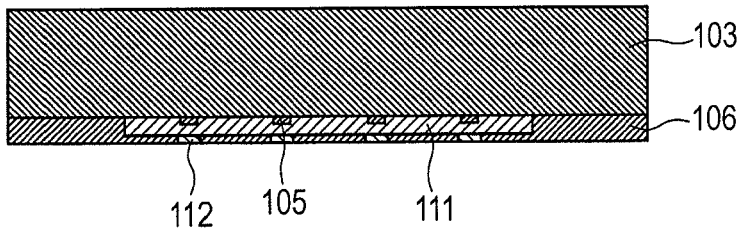
FIGS. 2A, 2B, 2C, 2D and 2E are sectional views for describing a process for producing a liquid ejection head according to Embodiment 1.

Firstly, as is illustrated in FIG. 2A, a substrate 103 is prepared which has a nozzle plate 106, a flow path pattern material 111, a protective layer 112, an etching stop layer (not-shown), an ejection energy generating element 105, and a conductor (not-shown).

More specifically, the etching stop layer is formed on the first surface of the substrate 103. The flow path pattern material 111 which becomes a mold of the liquid flow path is formed on the etching stop layer and the substrate 103. Next, a material of the nozzle plate is arranged on the substrate so as to cover the flow path pattern material 111. Next, an ejection orifice is formed with a photolithographic method or the like, and the nozzle plate 106 is formed. The protective layer 112 is a protective layer which protects at least the ejection orifice, and the protective layer can be provided so as to cover the ejection orifice and the nozzle plate.

The substrate 103 to be used is desirably a silicon substrate having a plane of crystal orientation <100>. The silicon substrate can be a single crystal silicon wafer.

The flow path pattern material 111 to be used is desirably a material which can be eluted by a medium or a solvent, and can be, for instance, a positive type resist material.

The nozzle plate 106 can employ, for instance, a negative type photosensitive resin.

The etching stop layer functions as a stop layer for etching, in a second etching which will be described later. The etching stop layer is etched sufficiently more slowly than the substrate 103 in the second etching, and is desirably etched sufficiently more quickly than the substrate 103 when being removed. Specifically, aluminum or silicon oxide, for instance, can be used as the material of the etching stop layer. In addition, hydrofluoric acid, a mixture of a phosphoric acid and a nitric acid, or the like, for instance, is used as a removing agent of the etching stop layer, and thereby a selection ratio for a sufficiently quick etching rate of the etching stop layer with respect to the silicon substrate can be acquired.

The ejection energy generating element 105 and the conductor (not-shown) which sends a drive signal to the ejection energy generating element 105 are formed on the substrate 103. The laminated material can be formed with a film-deposition technique such as a chemical vapor deposition (CVD; Chemical Vapor Deposition) method with the use of plasma and a sputtering vapor deposition method. In addition, an etching process with the use of a photoresist mask can be employed for the patterning of the etching stop layer, the ejection energy generating element, the conductor and the like.

It is desirable to protect the nozzle plate 106 side with the protective film.

Figure 2B:
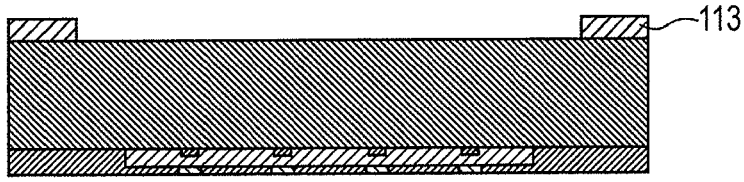

Next, as is illustrated in FIG. 2B, the first etching mask 113 for defining a position at which the cavity 101 is formed is formed on the second surface (hereinafter referred to also as rear surface) side of the substrate 103.

The first etching mask 113 can be formed by using a resist pattern. In addition, the first etching mask 113 has an aperture portion so as to correspond to a portion that will become the cavity 101 later. Incidentally, the first etching mask 113 may be previously formed when the substrate 103 is prepared. A polyether amide resin, for instance, can be used as a material of the first etching mask 113.

Figure 2C:
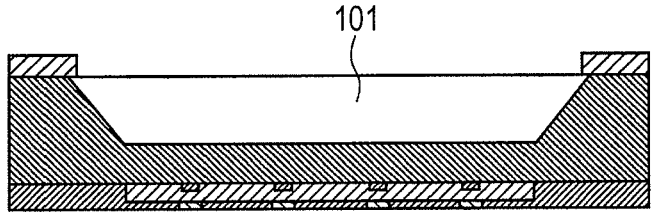

Next, as is illustrated in FIG. 2C, the cavity 101 is formed in the second surface of the substrate 103 by crystal anisotropic etching.

Etchants (chemicals) to be used for the crystal anisotropic etching include, for instance, an aqueous solution of tetramethylammonium hydroxide (aqueous solution of TMAH) and an aqueous solution of potassium hydroxide (KOH), but are not limited to these solutions. Incidentally, the cavity 101 may be previously formed when the substrate 103 is prepared.

The cavity 101 can be formed by removing 66% or less of a substrate thickness.

Figure 2D:
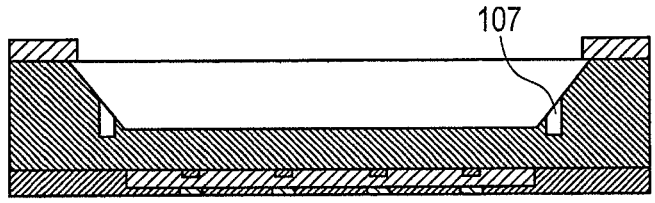

Next, as is illustrated in FIG. 2D, a chemical leading hollow 107 is formed in the slope (side wall) of the cavity 101.

Figure 2E:
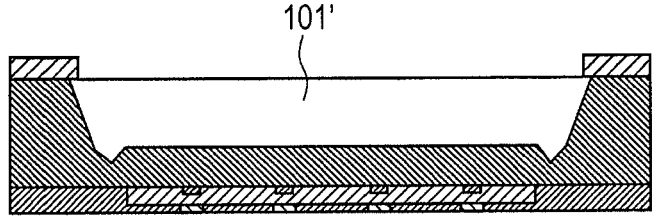

Next, as is illustrated in FIG. 2E, the cavity 101 is expanded by second crystal anisotropic etching. In other words, the slope of the cavity 101 is eroded by being subjected to the second crystal anisotropic etching from the second surface side, and the cavity 101 is expanded. The cavity which has been formed by the erosion of the slope by the second crystal anisotropic etching is referred to also as an expanded cavity (101'). In the second crystal anisotropic etching, an etchant enters into the chemical leading hollow 107, the etching progresses from the chemical leading hollow 107, thereby the side wall of the cavity 101 is etched, and the cavity is expanded.

In FIG. 2E, the slope of the cavity 101 is eroded by the second crystal anisotropic etching, and a groove shape is formed in an outer region of an end portion of the bottom face of the expanded cavity 101'.

In addition, in this process, the crystal anisotropic etching is conducted using such a chemical as to acquire a selection ratio of the etching rate of the (100) plane to that of an crystal plane having a higher index, and thereby the cavity 101 can be desirably expanded while the flatness of the bottom face of the cavity 101 is kept. In addition, the treatment can be conducted in a short period of time by using an aqueous solution of 18 to 23 wt % TMAH concentration, which has a large etching rate for the (110) plane.

Figure 5:
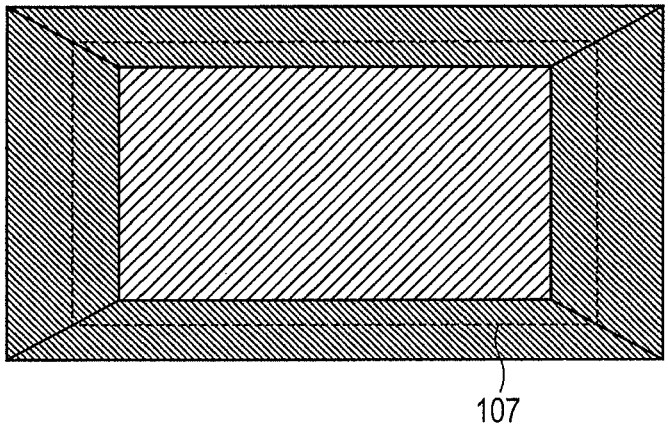
FIG. 5 is a schematic top plan view for describing an arrangement example of a chemical leading hollow.

The shape of the chemical leading hollow 107 includes a groove shape as well. When the shape of the chemical leading hollow 107 is a hole shape, for instance, the shape of the cross section of a plane in parallel with the substrate surface of the hole is an approximately rectangle shape, an approximately circular shape or an approximately elliptical shape, and the size can be set at approximately $\phi 5$ to $\phi 90$ μm, for instance. In addition, as is illustrated in FIG. 5, the chemical leading hollow can be formed in the slope of the cavity 101 so as to surround the bottom face of the cavity 101. For instance, as is illustrated in FIG. 5, the chemical leading hollow is provided in the slope of the cavity 101 so as to surround the bottom face of the cavity, in order to decrease the tilt in both longitudinal direction and transverse direction of the substrate. Incidentally, if the tilt in any direction does not need to be decreased, the chemical leading hollow may not be formed in the slope in the direction. In addition, the interval between the chemical leading hollows may be changed in the longitudinal direction and the transverse direction. The size of the chemical leading hollow can be appropriately selected in consideration of the easiness for the chemical to enter into the chemical leading hollow, a period of time required to form a desired depth and the like, in the second crystal anisotropic etching. As described above, the chemical leading hollow may form the groove shape, or may also form a plurality of holes which are connected to each other. In this case, there is such a merit that the flatness of the bottom face of the expanded cavity is enhanced.

In addition, there is such a tendency that as the chemical leading hollow is formed in the outer side of the slope (hereinafter referred to also as second surface side or aperture side), the etching progresses more easily to the lower side of the first etching mask 113, and the proportion of the cavity with respect to the area of the substrate increases. On the other hand, there is such a tendency that as the chemical leading hollow is formed in the inner side of the slope (hereinafter referred to also as bottom face side of cavity), the bottom face of the cavity is more etched and more decreases the flatness. For this reason, the chemical leading hollow is desirably formed at a position at which both of the increased ratio of the cavity and the decreased flatness are balanced, in consideration of the etching rate of the substrate. In addition, as for the depth of the chemical leading hollow, when the chemical leading hollow is excessively deep, the bottom face of the cavity tends to be easily etched. On the other hand, when the chemical leading hollow is excessively shallow, an effect of providing the chemical leading hollow results in being reduced. For this reason, the chemical leading hollow is desirably formed with a depth at which both of the easiness of etching and the reduced effect are balanced.

The chemical leading hollow 107 can be formed, for instance, by laser-beam machining, machine work or the like.

The chemical leading hollow 107 can be formed so as to be perpendicular to the surface direction of the substrate. In addition, the bottom part of the chemical leading hollow 107 can be formed so as to be located in a deeper position than the bottom face of the cavity 101.

Figure 3F:
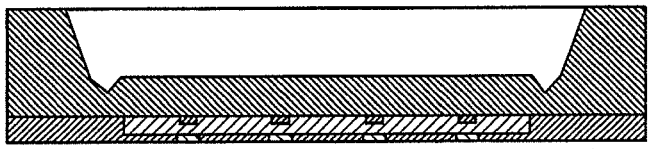
FIGS. 3F, 3G, 3H and 3I are sectional views for describing the process for producing the liquid ejection head according to Embodiment 1, which follow FIGS. 2A to 2E.

Next, as is illustrated in FIG. 3F, the first etching mask 113 is removed.

The first etching mask 113 can be removed, for instance, by wet peeling, dry peeling or a combination of both techniques. The first etching mask 113 can be removed, for instance, by ashing with the use of oxygen.

Figure 3G:
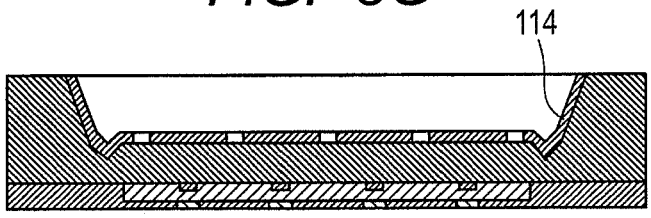

Next, as is illustrated in FIG. 3G, a second etching mask 114 is formed on the face (100) of the expanded cavity 101' defining a position at which the liquid supply port 102 is formed.

The second etching mask 114 can be formed, for instance, with a film-forming method such as a spin coating method, a dip coating method and a spray coating method. In addition, the second etching mask is preferably formed by the spray coating method, from the viewpoint of coverability for the slope. The material of the second etching mask is not limited in particular as long as the material functions as an etching-resistant mask during the dry etching operation, and can include, for instance, a derivative of a novolak resin and a derivative of naphthoquinone diazide. The exposure method for patterning to be used can be, for instance, a proximity exposure method, a projection exposure method and a stepper exposure method. When the depth of the expanded cavity 101' is deep, it is desirable to employ the projection exposure method with the shallow depth of a focus.

Figure 3H:
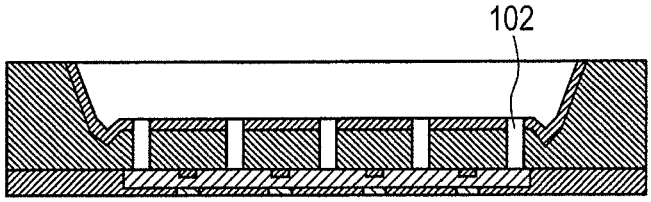

Next, as is illustrated in FIG. 3H, the liquid supply port 102 is formed by dry etching with the use of an ion.

The dry etching with the use of the ion can be reactive ion etching (RIE). The reactive ion etching (RIE) is directional etching with the use of an ion, and is a method of causing particles to collide against a region to be etched while providing electric charges. The RIE is a method of etching a substance with an accelerated ion. For instance, when an ICP (inductively coupled plasma) dry etching apparatus is used which can produce a high-density ion, as the ion source, the apparatus forms a liquid supply port perpendicularly to the substrate by alternately conducting coating and etching processes (in other words, deposition/etching process). In the deposition/etching process, $SF_6$ gas, for instance, can be used as an etching gas, and $C_4F_8$ gas, for instance, can be used as a coating gas. The Bosch process is a kind of a dry etching method, and firstly forms a coating on an etched portion of the substrate 103. Then, the substrate is exposed by etching the bottom face of the coated portion by using the RIE and further conducting etching of the substrate 103. By alternately repeating the coating process and the etching process (in other words, deposition/etching process), a desired liquid supply port 102 can be formed in the silicon substrate 103.

In addition, the dry etching in the present process is conducted until reaching the etching stop layer (not-shown) provided in the surface side of the substrate 103.

Figure 3I:
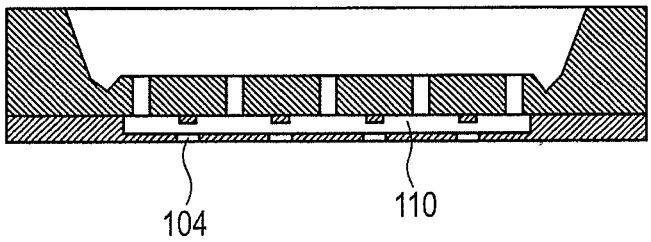

Next, as is illustrated in FIG. 3I, the second etching mask and the protective layer 112 are removed, and then the etching stop layer and the flow path pattern material 111 are removed through the liquid supply port 102 and the ejection orifice 104.

The etching stop layer can be removed, for instance, by using an alkaline solution or a mixture containing phosphoric acid and nitric acid.

After that, the liquid ejection head can be completed by separating a silicon wafer into a form of chips in each unit with a dicer.

Embodiment 2

Next, the present embodiment will be described below with reference to FIGS. 4A to 4C.

The present embodiment includes the same processes as those in Embodiment 1, until the cavity 101 is formed.

Figure 4A:
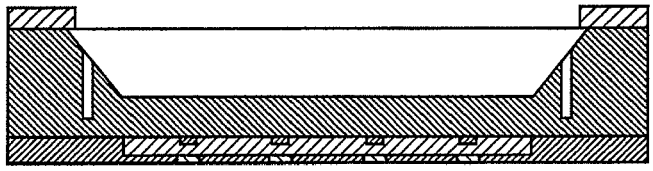
FIGS. 4A, 4B and 4C are sectional views for describing a process for producing a liquid ejection head according to Embodiment 2.
Figure 6:
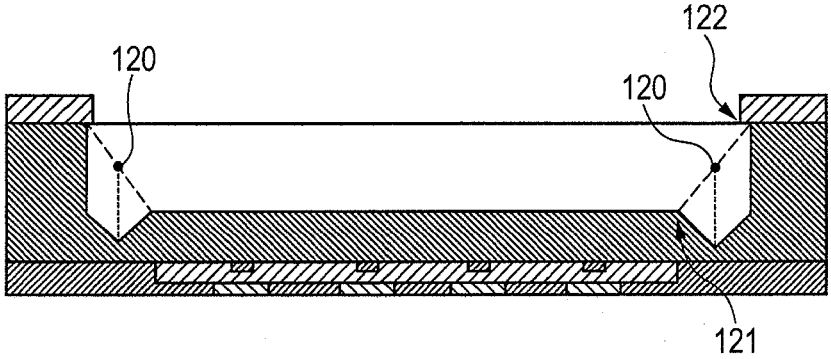
FIG. 6 is a schematic sectional view for describing positions of arranged chemical leading hollows according to Embodiment 2.

In the present embodiment, as is illustrated in FIG. 4A, in a process of forming the chemical leading hollow 107 in the slope of the cavity 101, the chemical leading hollow 107 can be formed in the following region. To be specific, the chemical leading hollow 107 is formed so that the position of the chemical leading hollow in the slope of the cross section of the substrate is outside a middle point between the upper end of the side wall and the bottom face end of the expanded cavity 101' or is at the middle point, and the end (bottom part) of the chemical leading hollow is closer to the first surface of the substrate 103 than the bottom face of the expanded cavity 101' (see FIG. 6). The cross section of the substrate can be a cross section of a plane which passes through the chemical leading hollow, is parallel to one side of the aperture of the cavity 101 and is perpendicular to the substrate. In FIG. 6, an upper end 122 of the side wall of the expanded cavity 101' is shown, and a bottom face end 121 of the expanded cavity 101' is shown. Incidentally, "outside" means an outside in the aperture of the cavity.

Figure 4B:
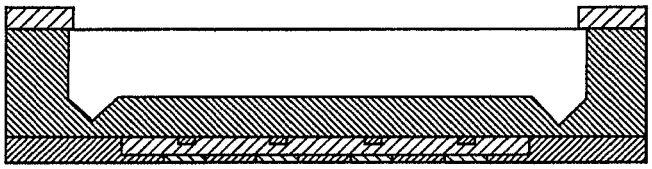

Next, as is illustrated in FIG. 4B, the crystal anisotropic etching is conducted until an angle formed by the second surface of the substrate 103 and the side wall of the expanded cavity 101' connected to the second surface becomes 90 degrees or less.

The subsequent processes are the same as in Embodiment 1.

Figure 4C:
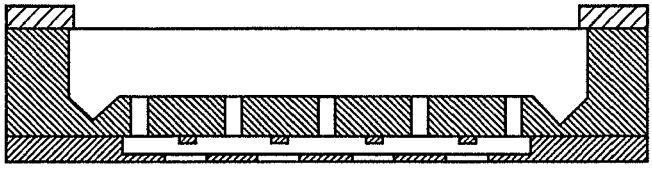

By processing the substrate as in the present embodiment, a liquid ejection head as illustrated in FIG. 4C can be obtained, which is provided with a wider distance between a region in which the liquid supply port 102 is provided and the side wall of the cavity. In such a liquid ejection head, the side wall of the cavity 101 can be largely eroded, and the occurrence of the tilt can be decreased, while the mounting region is secured. In addition, a treatment period of time for crystal anisotropic etching becomes short, and the flatness of the bottom face of the cavity 101 can be kept.

EXAMPLES AND COMPARATIVE EXAMPLES

A liquid ejection head of an example, which was produced with a process for eroding the side wall of the cavity 101 according to the embodiment, and a liquid ejection head of a comparative example, which was produced with a conventional process that does not erode the side wall of the cavity 101, were evaluated.

As the comparative example having employed the conventional process, a liquid ejection head was produced by forming the cavity by crystal anisotropic etching, and then forming a liquid supply port in the bottom part of the cavity. As the example of the production process according to the present embodiment, liquid ejection heads were produced by eroding the side wall of the cavity 101 until the distance between the side wall of the expanded cavity 101' and the liquid supply port 102 which was closest to the side wall was 200 μm or 400 μm. Table 1 shows the angle of the liquid supply port 102 which was closest to the side wall of the expanded cavity 101', in each of the liquid ejection heads. As is shown in Table 1, it was confirmed that the tilt could be decreased according to the present embodiment.

TABLE 1

| | Comparative Example (conventional process) | Example (200 μm) | Example (400 μm) |
|---|---|---|---|
| Angle of supply port | 88.6 Degree | 88.8 Degree | 89.0 Degree |
| Difference between angles | | 0.2 Degree | 0.4 Degree |

In the above described examples, the liquid ejection heads were obtained by the following process. In other words, the liquid ejection heads were produced based on sectional views illustrated in FIGS. 2A to 2E and FIGS. 3F to 3I. A production example of the liquid ejection heads in the present examples will be described below.

In the present embodiment, a single crystal silicon wafer was prepared as a substrate.

In the process of FIG. 2A, silicon oxide was used as an etching stop layer.

In the process of FIG. 2B, the first etching mask 113 was formed firstly by forming a polyether amide resin, and patterning the polyether amide resin by using a photoresist.

In the process of FIG. 2C, the first crystal anisotropic etching was conducted by immersing the substrate into an aqueous solution of tetramethylammonium hydroxide at 85° C. to form the cavity 101.

In the process of FIG. 2D, a chemical leading hollow was formed by using a third harmonic laser beam (THG: wavelength of 355 nm) of the YAG laser. The diameter of the chemical leading hollow was set at approximately ϕ40 μm, the pitch was set at 100 μm, and the chemical leading hollow was formed in an arrangement position as illustrated in Embodiment 2.

In the process of FIG. 2E, the cavity 101 was expanded by crystal anisotropic etching.

In the process of FIG. 3F, the first etching mask 113 was removed by ashing with the use of oxygen.

In the process of FIG. 3G, the second etching mask 114 was formed in the following way. Firstly, a photosensitive positive resist was arranged by using a spray coating method which has excellent coverability with respect to the face having inclination. AZ-P4620 (trade name, made by AZ Electronic Materials Co.) was used as the photosensitive positive resist. In order to define the position of the liquid supply port 102, the photosensitive positive resist was exposed and patterned with an exposure light amount of 1,000 mJ/cm$^2$ through a mask having a pattern which defined the position of the liquid supply port, by using a projection exposure device UX-4023 (trade name) made by USHIO INC.

In the process of FIG. 3H, a liquid supply port was formed by reactive ion etching with the use of the Bosch process, by using an MUC-21 Pegasus (trade name, made by Sumitomo Precision Products Co., Ltd.). Here, $SF_6$ gas was used as an etching gas in the Bosch process, and $C_4F_8$ gas was used as a coating gas in the Bosch process. As for the conditions of reactive ion etching, the flow rate of $SF_6$ gas was set between 50 sccm and 1,000 sccm, the flow rate of $C_4F_8$ gas was set between 50 sccm and 1,000 sccm, and the pressures of the gases were set between 0.5 Pa and 50 Pa.

In the operation of FIG. 3I, the etching stop layer was removed by using an alkaline solution.

Finally, a liquid ejection head was obtained by separating the silicon wafer into the form of the chips in each unit with a dicer.

The present invention can provide a process for producing a liquid ejection head, which can decrease tilt while securing the mounting region, when forming a liquid supply port in a cavity of a silicon substrate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-005081, filed Jan. 13, 2012, which is hereby incorporated by reference herein in its entirety.

What is claimed is:

1. A process for producing a liquid ejection head that comprises a crystal silicon substrate having a first surface and a second surface that is a surface on an opposite side to the first surface, an ejection energy generating element which is formed on a side of the first surface and generates energy for ejecting a liquid, a cavity formed in the second surface, and a liquid supply port which is formed in a bottom part of the cavity and communicates with the first surface, the process comprising, in the following order:

(1) forming the cavity in the second surface of the silicon substrate by a first crystal anisotropic etching;

(2) forming a chemical leading hollow in a slope of the cavity;

(3) expanding the cavity by a second crystal anisotropic etching; and (4) forming the liquid supply port in a bottom face of the cavity by dry etching with the use of an ion.

2. The process for producing the liquid ejection head according to claim 1, wherein an end of the chemical leading hollow is closer to the first surface than the bottom face of an expanded cavity.

3. The process for producing a liquid ejection head according to claim 2, wherein in the step (3), an angle formed by the second surface and the side wall of an expanded cavity connected to the second surface is 90 degrees or less.

4. The process for producing a liquid ejection head according to claim 1, wherein the dry etching is reactive ion etching.

5. The process for producing a liquid ejection head according to claim 4, wherein the reactive ion etching is etching with the use of a Bosch process.

6. The process for producing a liquid ejection head according to claim 1, wherein the step (1) comprises:

(A) forming a first etching mask for defining a position at which the cavity is formed in the second surface of the silicon substrate; and (B) forming the cavity in the silicon substrate by the first crystal anisotropic etching from the second surface side.

7. The process for producing a liquid ejection head according to claim 1, wherein the step (4) comprises:

(C) forming a second etching mask for defining a position at which the liquid supply port is formed in the bottom part of an expanded cavity; and (D) forming the liquid supply port by the dry etching using the second etching mask.

8. The process for producing a liquid ejection head according to claim 1, wherein a slope between the chemical leading hollow and the bottom face of the cavity is eroded by the second crystal anisotropic etching.

9. The process for producing a liquid ejection head according to claim 1, wherein a groove shape is formed in an outer region of an end portion of the bottom face of the cavity by the second crystal anisotropic etching.

10. The process for producing a liquid ejection head according to claim 1, wherein in the step (3), the second crystal anisotropic etching is conducted by using an aqueous solution of TMAH with a TMAH concentration of 18 to 23 wt %.

11. The process for producing a liquid ejection head according to claim 1, wherein the chemical leading hollow is formed by laser-beam machining.

* * * * *